US007086809B2

(12) United States Patent
Busso

(10) Patent No.: US 7,086,809 B2
(45) Date of Patent: Aug. 8, 2006

(54) MINIMUM FLOATING OFFSHORE PLATFORM WITH WATER ENTRAPMENT PLATE AND METHOD OF INSTALLATION

(75) Inventor: Catherine Busso, Houston, TX (US)

(73) Assignee: Marine Innovation & Technology, Berkeley, CA (US)

( * ) Notice: Subject to any disclaimer, the term of this patent is extended or adjusted under 35 U.S.C. 154(b) by 0 days.

(21) Appl. No.: 10/348,135

(22) Filed: Jan. 21, 2003

(65) Prior Publication Data

US 2004/0141812 A1 Jul. 22, 2004

(51) Int. Cl.
*E02D 29/00* (2006.01)

(52) U.S. Cl. ..... 405/203; 405/207; 405/224; 114/264

(58) Field of Classification Search ..... 405/195.1, 405/203–207, 224, 224.2; 114/264–267
See application file for complete search history.

(56) References Cited

U.S. PATENT DOCUMENTS 3,176,644 A * 4/1965 Thomas et al. ..... 114/126
3,397,545 A * 8/1968 Leavitt ..... 405/208
3,739,737 A * 6/1973 Baier ..... 114/265
4,098,333 A * 7/1978 Wells et al. ..... 166/352
4,112,697 A * 9/1978 Chow ..... 405/207
4,266,496 A * 5/1981 Carlsen ..... 114/126
4,666,341 A * 5/1987 Field et al. ..... 405/203
5,435,262 A * 7/1995 Grinius et al. ..... 114/264
5,558,467 A * 9/1996 Horton ..... 405/195.1
5,722,797 A * 3/1998 Horton, III ..... 405/224
6,206,614 B1 * 3/2001 Blevins et al. ..... 405/224
6,637,979 B1 * 10/2003 Finn et al. ..... 405/224.2
6,652,192 B1 * 11/2003 Xu et al. ..... 405/195.1
6,761,124 B1 * 7/2004 Srinivasan ..... 114/264
2001/0000718 A1 * 5/2001 Blevins et al. ..... 405/205

* cited by examiner

*Primary Examiner*—Jong-Suk (James) Lee

(57) ABSTRACT

An apparatus for use in offshore oil or gas production in which a plurality of vertical stabilizing columns are supported on a submerged horizontal water entrapment plate is provided to support minimum offshore oil and gas production facilities above a subsea wellhead, or subsea processing facilities, or a submarine pipeline, and whose main function is to provide power or chemicals or to perform other operations such as compression, injection, or separation of water, oil and gas. The apparatus is maintained in the desired location by a plurality of mooring lines anchored to the sea-bed. The respective size and shape of the columns and water entrapment plate are designed to provide sufficient buoyancy to carry the weight of all equipment on the minimum floating platform and mooring lines, umbilical and risers attached to it, and to minimize the platform motion during normal operations.

3 Claims, 6 Drawing Sheets

MINIMUM FLOATING OFFSHORE PLATFORM WITH WATER ENTRAPMENT PLATE AND METHOD OF INSTALLATION

BACKGROUND OF THE INVENTION

The present invention relates to a floating apparatus for supporting an offshore platform. The apparatus of the invention includes a plurality of vertical columns attached to a submerged horizontal water entrapment plate on their lower end, and to a deck which supports minimum offshore facilities for the production of hydrocarbons offshore on their upper end.

More particularly, the present invention relates to a floating structure comprising a plurality of vertical columns connected to a horizontal water entrapment plate, the said plate covering the space between the columns and extending outwardly from the lower end of each column such as to form a section of a polygon or circle. In another aspect, the present invention relates to methods for supporting minimum facilities required for the production of offshore hydrocarbon reservoirs from marginal fields.

With increasing exploration activities from offshore basins, such as the Gulf of Mexico, numerous discoveries of relatively small hydrocarbon accumulations have taken place. Many of these fields do not contain sufficiently large amount of oil or gas to justify the expenses of a stand-alone field development, such as a production platform and pipeline infrastructure. In many instances, however, these fields can be produced using subsea-tiebacks to existing infrastructure. These include a subsea wellhead and a flowline to an existing production platform for example.

Serious limitations are expected with longer subsea tie-back, such as plugging of the line due to a decrease in pressure and temperature along the flowline. Conventional remedial measures include injection of chemicals to prevent formation of hydrates. Such chemicals can be transported from the host platform to the subsea wellhead in an umbilical, and can be injected into the flowline at the wellhead. The umbilical can also be used to control the subsea wellhead. The cost of such umbilical is typically very large, and economics of a subsea tie-back is often threatened by the excessive umbilical cost for tie-back distances greater than 20 miles. An alternative development scenario consists of providing a minimum offshore platform near the wellhead with remote control from the host platform and injection of chemicals stored on the minimum offshore platform via a short umbilical connected to the subsea wellhead.

In some cases, where multiphase hydrocarbon flow is expected, the tie-back distance is further limited because of flow assurance issues. Current technological developments are aimed at providing subsea separation facilities to allow hydrocarbons to flow over a greater distance. Such subsea facilities may require additional surface facilities such as power generation and complex control capability.

Similarly, equipment such as subsea pumps may be required to assist flow assurance over the tie-back length. Such pump require power which can be provided by a surface facility located above the pump.

Other technological solutions provided to the flow assurance problem for extended tie-back include electrically heated flowline, which may be heated either continuously or before start-up. The power required to heat the flowline may be produced by a generator located on minimum offshore facilities floating above the flowline.

Current technologies allow certain processing operations to be performed using much smaller equipment than traditional technologies. A minimum offshore platform could therefore be used to perform operations currently conducted on much larger platforms. This could further extend the distance over which hydrocarbon can be transported allowing them in cases to reach the shore directly for further processing.

It is envisioned that future technologies such as fuel cell conversions could be conducted on minimum offshore facilities and power could be shipped via an electrical cable back to shore.

A minimum offshore platform can also be used to perform basic maintenance workover on the wellhead. This saves the high cost of mobilization of a vessel suitable for typical workover operation.

Therefore, there is a need for minimum offshore platform in order to reduce the cost of development of marginal fields so as to make them profitable.

The apparatus described in U.S. patent application 20020044838 filed Feb. 28, 2001 provides a support for minimum offshore facilities, however due to its shape this apparatus suffers from excessive wave induced motion which makes access difficult and dangerous in inclement weather. In addition the motion characteristics result in fatigue of the umbilical or risers connected to it. Due to its motion, it is not possible to land on this facility with a helicopter.

Other platforms, commonly referred to as semi-submersible platforms, have been developed to perform a number of activities related to exploration of and production from hydrocarbon reservoirs. Because of their design including generally rectangular or cylindrical pontoons, their size must be very large, most often in excess of 20,000 tons displacement, in order to provide sufficient stability during extreme weather events. These platforms can therefore carry a large payload, in excess of several thousands tons, but consequently their cost is high, and because of their large size, the required mooring system is also very large and costly.

Thus, in spite of advancements in the art, there still exists a need for a low cost offshore platform to support relatively small payloads for the development of marginal offshore fields, which do not suffer from the disadvantages of the prior art apparatuses.

SUMMARY OF THE INVENTION

It is an object of the present invention to provide an apparatus and a method for developing marginal fields. It is another object of the present invention to provide an apparatus and a method for developing marginal fields which do not suffer from the drawbacks of the prior art apparatuses and methods.

According to one embodiment of the present invention, there is provided an offshore platform comprising a buoyant substructure, a deck supporting minimum offshore facilities, mooring lines connecting the platform to the seafloor, and an umbilical between the platform and subsea facilities located approximately beneath the platform on the seafloor.

The substructure of the present invention is comprised of three vertical buoyant columns attached to a horizontal water entrapment plate at their lower end and to a deck that supports offshore facilities at their upper end. The horizontal plate extend radially from each column and covers the triangle formed by the center of the columns base. Offshore facilities include but are not restricted to any combination of the following equipment: a power generator to provide electricity to subsea facilities located beneath the platform on the seafloor, hydraulic motors to provide hydraulic power to a subsea wellhead or manifold, antennas and other communication equipment to exchange information with a host platform, a helideck, chemical storage and distribution systems, overnight accommodations for maintenance personnel, a crane or gantry to move equipment on the deck, a winch and A frame to perform workover on the wellhead, pumps or compressors to boost pressure in the tie-back flowline.

DETAILED DESCRIPTION OF THE INVENTION

Figure 1:
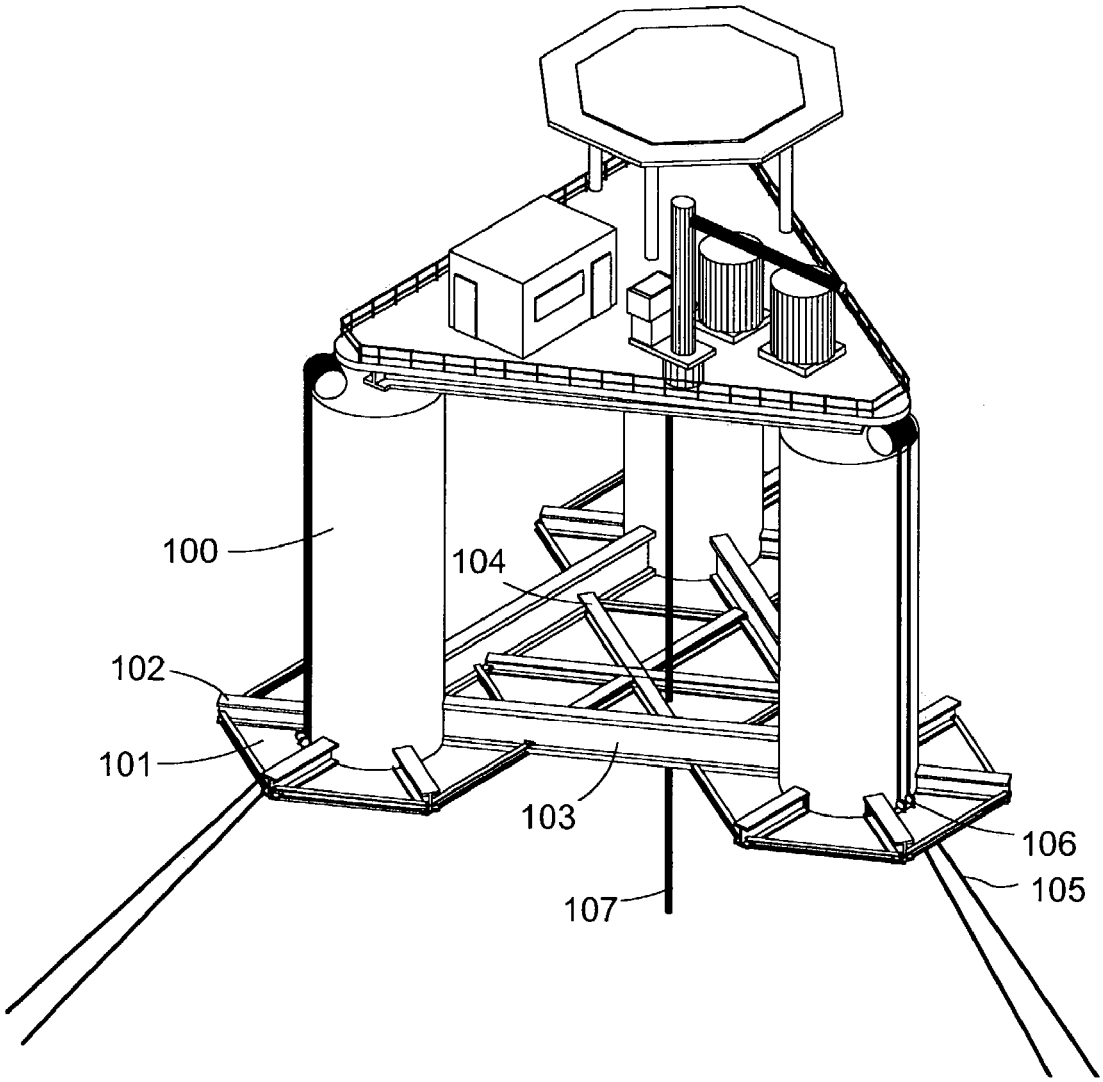
FIG. 1 is a perspective view of a preferred embodiment of the present invention in a three-columns configuration.

The present invention, as shown in FIG 1, is comprised of three vertical columns 100 attached to a horizontal water entrapment plate 101. The water entrapment plate is supported by a set of beams 102 extending radially from the lower end of each column. Larger members or transverse beams 103 connect the columns together and serve as structural support for other framing member 104 that carry the hydrodynamic and structural forces on the water entrapment plate.

The mooring lines 105 run onto the fairleads 106 and through an opening on the water entrapment plate. An umbilical 107 is attached to facilities on the deck and runs trough an opening near the center of the water entrapment plate. A bend restrictor is installed beneath the plate so as to restrict bending of the umbilical due to environmental forces and associated motion of the platform and umbilical.

The submerged horizontal water entrapment plate is attached to the lower part of stabilizing columns. It is designed to provide increased resistance to vertical accelerations and to roll and pitch rotational accelerations. This plate is referred to herein as "water entrapment plate" because large amounts of water are displaced as the plate tends to move vertically.

Figure 2:
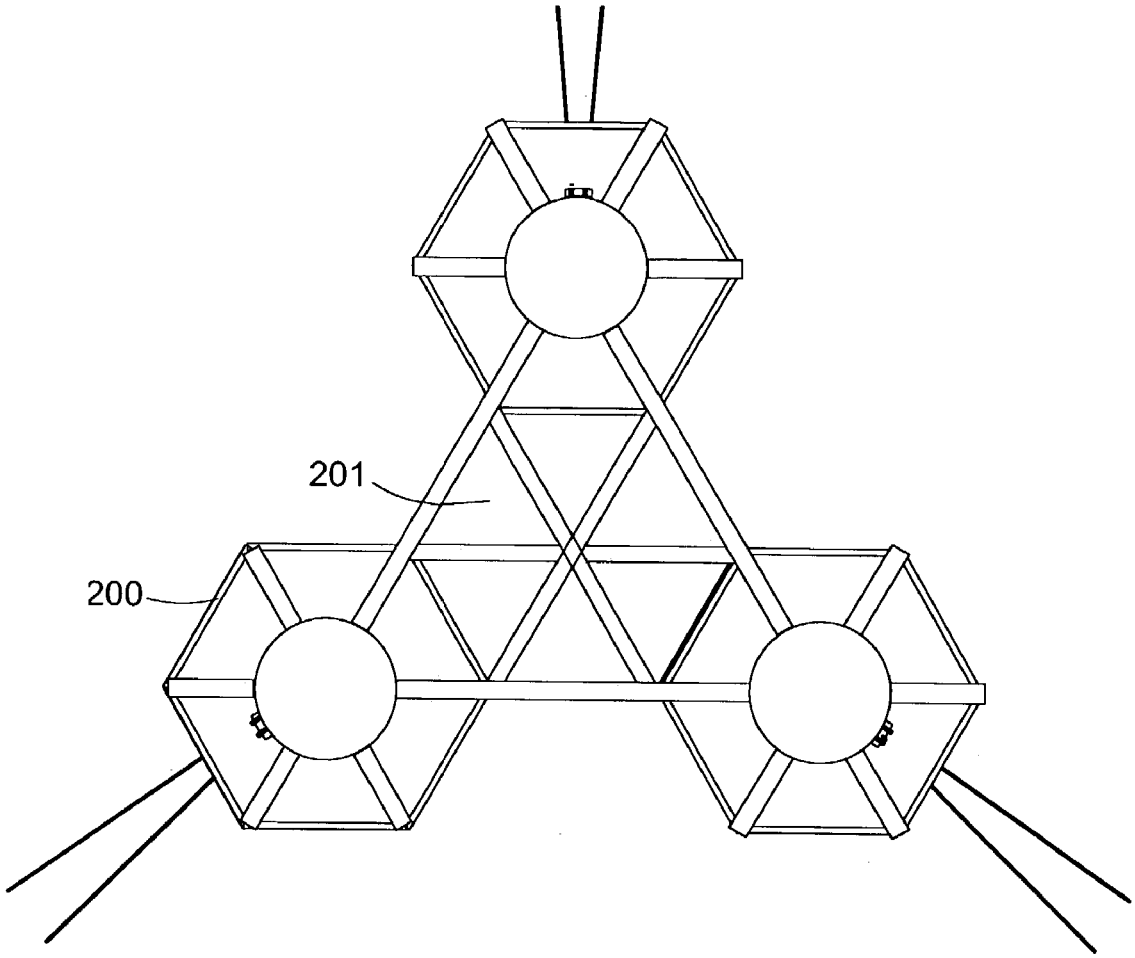
FIG. 2 is a plane view of the substructure of the present invention in a three-columns configuration.

The plate size and shape is adjusted so that the natural heave, pitch and roll period of the platform significantly exceeds the wave period of operational sea-states. This ensures that the platform motion remains small during normal operation. As a consequence, it is easy to land a helicopter on the platform in most wave conditions. The plate extends radially from each column forming a section of hexagon 200 in the present embodiment as shown in FIG. 2. The radial distance can be adjusted to control the natural roll and pitch period. The plate sections extending within the triangle defined by the center of each column base are extended so as to form a continuous plate 201. The overall plate area is adjusted to control the heave natural period. The water entrapment plate may be located at the base of the columns or somewhat higher to ease construction and operation of the apparatus.

Figure 3:
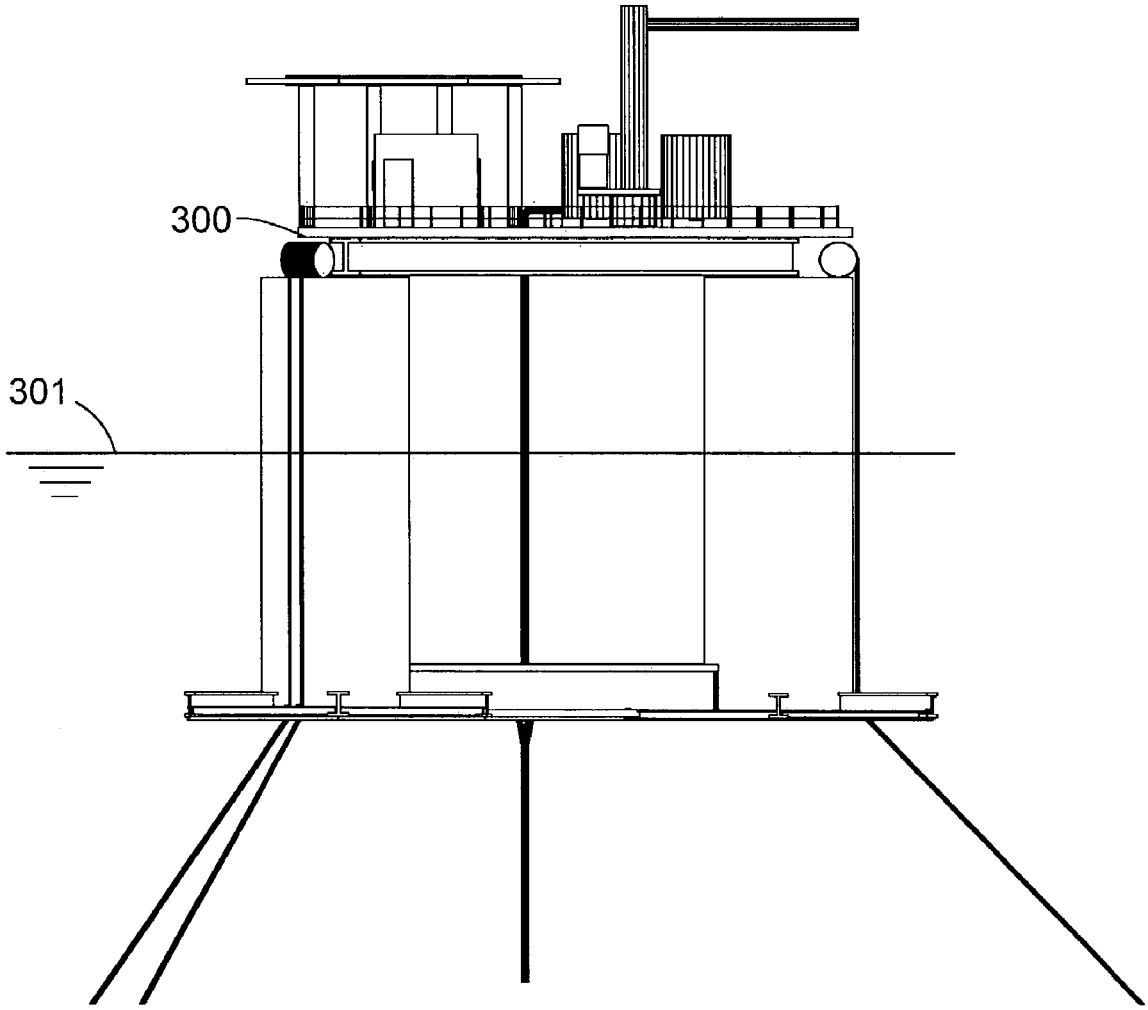
FIG. 3 is an outboard profile of the present invention in a three-columns configuration.

Furthermore, the natural heave, pitch and roll period of the platform is adjusted to be slightly larger than the peak period of extreme weather conditions, such as hurricane in the Gulf of Mexico. Because of the large amount of damping provided by the horizontal water entrapment plate, the platform heave, pitch and roll during extreme weather conditions is such that the platform approximately follows the water surface. As a result, referring to FIG. 3, the clearance between the deck 300 and the wave surface 301 remains sufficient even if the deck is much lower than that of larger, conventional platforms such as semi-submersible drilling rigs, tension leg platforms and spars.

The present apparatus can easily be assembled in a dry-dock or fabrication yard using prefabricated elements such as beams, plates, and columns, and it can then be fitted with its equipment. After completion and pre-commissioning, it can be floated out to sea and towed to its installation site where the mooring system has been pre-installed. The mooring lines are then connected to a section of chain located on the apparatus and pre-tensioned to a specified tension value. Umbilical or risers are then pulled-in using a winch located on the present apparatus and connected with the required pretension.

Figure 4:
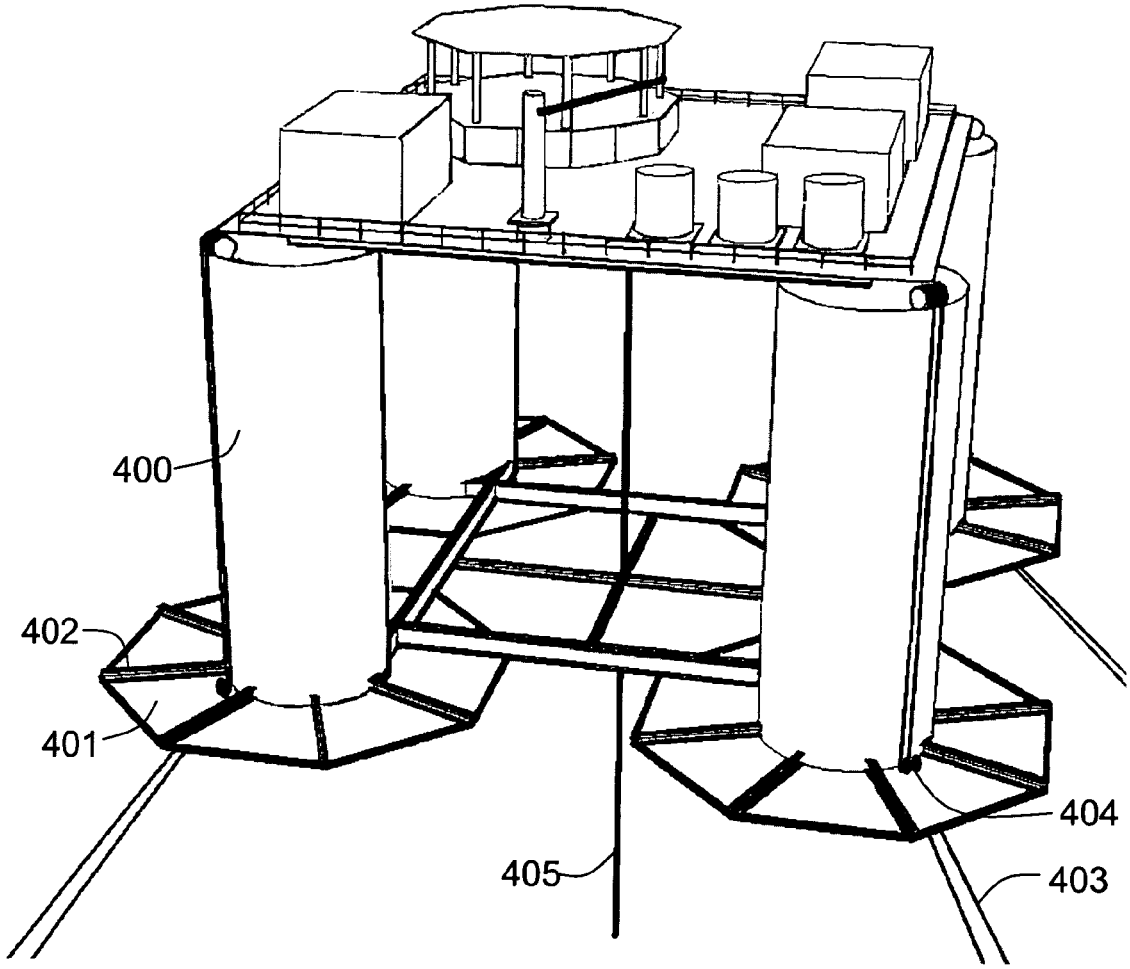
FIG. 4 is a perspective view of a preferred embodiment of the present invention in a four-columns configuration.
Figure 5:
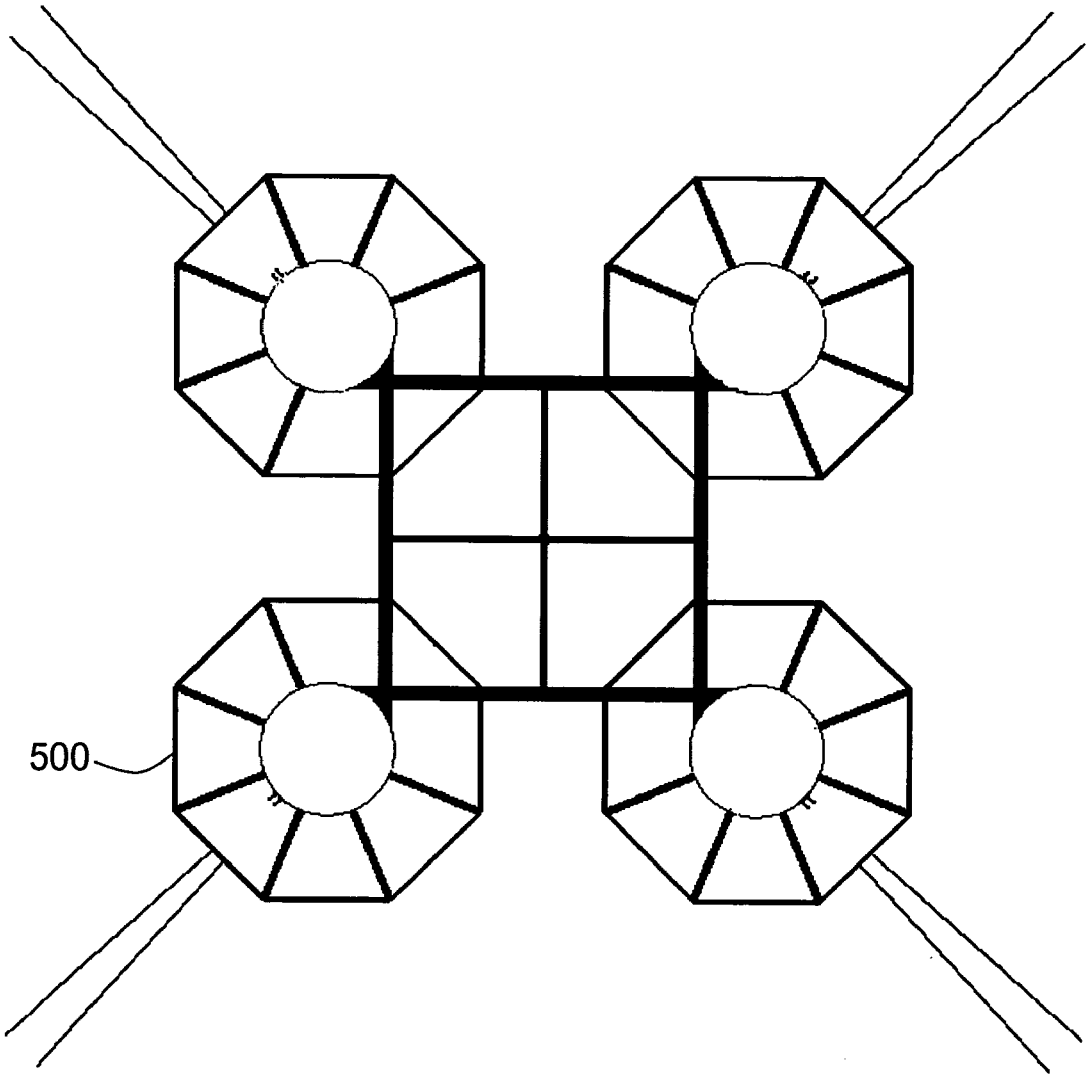
FIG. 5 is a plane view of the substructure of the present invention in a four-columns configuration.
Figure 6:
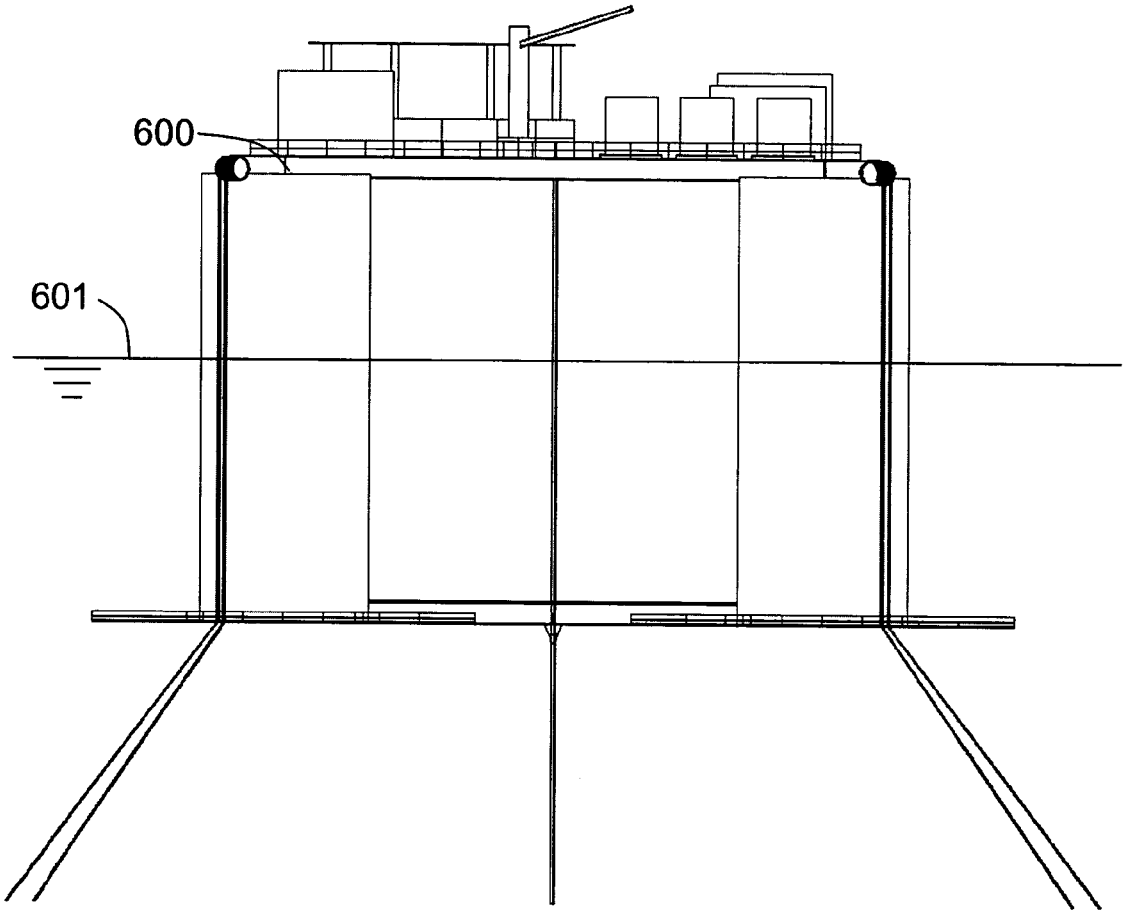
FIG. 6 is an outboard profile of the present invention in a four-columns configuration.

Similarly, the four-columns configuration, shown in FIG. 4, is comprised of four vertical columns 400 attached to a water entrapment plate 401, stiffened by structural members 402. The mooring lines 403 run onto the fairleads 404 and through an opening in the water entrapment plate. An umbilical 405 connects to the subsea facilities. The polygonal shape of the water entrapment plate 500 is shown in FIG. 5. Referring now to FIG. 6, the platform deck 600 clearance above the wave surface 601 remains positive even during large storms.

While the illustrative embodiments of the invention have been described with specific details, it is understood that various modifications can be readily made by those skilled in the art without departing from the spirit and scope of the invention. Accordingly, the scope of the claims appended hereto is not limited to the description provided herein but encompasses all the patentable features of the present invention, including all features which would be treated as equivalents thereof by those skilled in the art to which this invention pertains.

I claim:

1. A column-stabilized offshore platform with its center of gravity located above its center of buoyancy comprising:

a plurality of vertical columns;

a submerged substantially horizontal water entrapment plate attached to the lower end of each of said columns extending outwardly such as to form a section of circle or polygon around the base of each column and, wherein said water entrapment plate is supported by a plurality of radial beams each connected at one end to the base of said columns, and at the other end to the edges of said water entrapment plate, and transverse beams each connected at its both ends to the base of said columns and providing continuous support to said water entrapment plate;

a deck attached to the upper ends of said columns for supporting hydrocarbon production equipment.

2. The offshore platform of claim 1, further comprising three columns disposed about a vertical axis to form a triangle.

3. The offshore platform of claim 1, further comprising four columns disposed about a vertical axis to form a quadrilateral.

* * * * *